US009125469B2

(12) United States Patent
Longoria et al.

(10) Patent No.: US 9,125,469 B2
(45) Date of Patent: Sep. 8, 2015

(54) HAIR DECORATING SYSTEM AND METHOD

(71) Applicants: Kennedy-Matsumoto Design LLC, Santa Barbara, CA (US); Longoria Design LLC, Miami, FL (US)

(72) Inventors: Jose Longoria, Miami, FL (US); Melvin R Kennedy, Santa Barbara, CA (US)

(73) Assignees: Kennedy-Matsumoto Design LLC., Santa Barbara, CA (US); Longoria Design LLC., Miami, FL (US)

( * ) Notice: Subject to any disclaimer, the term of this patent is extended or adjusted under 35 U.S.C. 154(b) by 0 days.

(21) Appl. No.: 14/493,829

(22) Filed: Sep. 23, 2014

(65) Prior Publication Data

US 2015/0090290 A1 Apr. 2, 2015

Related U.S. Application Data

(60) Provisional application No. 61/960,797, filed on Sep. 27, 2013, provisional application No. 61/962,415, filed on Nov. 7, 2013, provisional application No. 61/967,186, filed on Mar. 13, 2014.

(51) Int. Cl.
*A45D 8/34* (2006.01)
*A45D 8/00* (2006.01)

(52) U.S. Cl.
CPC ..... *A45D 8/34* (2013.01); *A45D 2008/004* (2013.01)

(58) Field of Classification Search
CPC ..... A45D 8/00; A45D 8/02; A45D 8/34; A45D 8/36; A45D 2008/002; A45D 2008/004; A45D 2008/008
USPC ..... 132/273, 275, 276; 24/115 N, 129 C, 24/131 C
See application file for complete search history.

(56) References Cited

U.S. PATENT DOCUMENTS

| | | | | | |
|---|---|---|---|---|---|
| 303,341 | A | * | 8/1884 | Thompson et al. | 132/283 |
| 2,924,228 | A | * | 2/1960 | McGee | 132/273 |
| 3,832,841 | A | | 9/1974 | Cole | |
| 5,271,421 | A | * | 12/1993 | Videtzky | 132/200 |
| 5,404,892 | A | | 4/1995 | Bretl | |
| 5,465,741 | A | * | 11/1995 | Dvorak | 132/275 |
| D372,338 | S | * | 7/1996 | Engel et al. | D28/41 |

(Continued)

FOREIGN PATENT DOCUMENTS

| | | | |
|---|---|---|---|
| DE | 29801558 | U1 | 4/1998 |
| FR | 2799349 | A1 | 4/2001 |
| WO | 2012174687 | A1 | 12/2012 |

OTHER PUBLICATIONS

NativeTech: Native American Technology and Art; Native American Featherwork, Single Wrapped Feathers Style 1 Traditional, http://www.nativetech.org/feather/warp/fet1inst.html, pp. 1-2, Feb. 29, 2000.*

(Continued)

*Primary Examiner* — Todd Manahan
*Assistant Examiner* — Tatiana Nobrega
(74) *Attorney, Agent, or Firm* — Perry Hoffman

(57) ABSTRACT

A hair decorating system that includes a string covered in wax in a first configuration, coiled around an interior segment in a second configuration where end segments are attached, and a third configuration where the coil has been extended to form a crisscrossed pattern around a strand of hair. The criss-crossed pattern is both attractive and decorative.

7 Claims, 8 Drawing Sheets

(56) References Cited

U.S. PATENT DOCUMENTS

| | | | | |
|---|---|---|---|---|
| 5,671,759 | A | 9/1997 | Chung et al. | |
| 5,810,022 | A * | 9/1998 | Reynolds | 132/200 |
| 5,878,755 | A * | 3/1999 | Crabtree et al. | 132/273 |
| 5,881,736 | A | 3/1999 | Turner et al. | |
| 6,041,792 | A | 3/2000 | Kennedy | |
| D432,264 | S | 10/2000 | Nicol | |
| 6,164,292 | A * | 12/2000 | Di Maria Poole et al. | 132/275 |
| 6,192,893 | B1 * | 2/2001 | Katsumata | 132/273 |
| 6,260,559 | B1 | 7/2001 | Schirren et al. | |
| 6,325,073 | B1 * | 12/2001 | Di Maria Poole et al. | 132/275 |
| 6,637,441 | B2 | 10/2003 | Kennedy et al. | |
| 6,647,989 | B1 | 11/2003 | De Benedictis | |
| 6,662,808 | B2 | 12/2003 | Leason et al. | |
| 6,758,221 | B1 * | 7/2004 | Stachowski | 132/273 |
| 7,328,710 | B2 * | 2/2008 | Hall et al. | 132/208 |
| D635,297 | S * | 3/2011 | Hsu | D28/39 |
| 2002/0166567 | A1 * | 11/2002 | Potter et al. | 132/280 |
| 2004/0231689 | A1 * | 11/2004 | Kobayashi et al. | 132/222 |
| 2007/0175493 | A1 * | 8/2007 | Tandberg et al. | 132/275 |
| 2008/0035164 | A1 * | 2/2008 | Callahan | 132/200 |
| 2008/0099036 | A1 * | 5/2008 | Crowley et al. | 132/275 |
| 2012/0211020 | A1 * | 8/2012 | Garcia | 132/273 |

OTHER PUBLICATIONS

NativeTech: Native American Technology and Art; Native American Featherwork, SIngle Wrapped Feathers Style 2 COntemporary Prairie, http://www.nativetech.org/feather/warp/fet2inst.html, pp. 1-2, Feb. 29, 2000.*

The Ashley Book of Knots by Clifford W. Ashley, Doubleday, p. 548, Portuguese Whipping 3452, 1993.*

* cited by examiner

HAIR DECORATING SYSTEM AND METHOD

PRIORITY CROSS-REFERENCE TO RELATED APPLICATION

This application claims priority pursuant to 35 U.S.C. 119 (e) or 120 from U.S. Provisional Applications No. 61/960,797, filed Sep. 27, 2013, entitled "HAIRWRAPPING ACCESSORY," No. 61/962,415, filed Nov. 7, 2013, entitled "COILED HAIR STYLING ACCESSORY" and No. 61/967,186, filed Mar. 13, 2014, entitled "HAIR WRAPPING ACCESSORY" which are incorporated herein by reference.

FIELD OF THE INVENTION

The present invention relates generally to a hair decorating system, and, more particularly, to a hair decorating system featuring a crisscrossed string pattern and a tool for pulling a strand of hair through the string when was compactly coiled, the result being an attractive and decorative hair arrangement with simple yet robust apparatus that are easy and fun to use.

BACKGROUND OF THE INVENTION

Hair decorating is well known and has existed for centuries. Various devices have been used with numerous designs and patterns. More recently, some of the devices and designs have been disclosed in multiple patents and published applications. By way of example, the patents and applications may be categorized in the following manner: first, helical or spiral devices, second, hair ties, clips, braids, rings or tubes and third, devices for applying a helical or spiral cords to strands of hair. The patents and applications disclosing helical or spiral devices include: U.S. Pat. No. 2,924,228 issued in 1960 to McGee and entitled "Ladies' Hair Clasp Device"; U.S. Pat. No. 5,271,421 issued in 1993 to Videtzky entitled "Hair Retaining Device"; U.S. D372,338 issued in 1996 to Engel and Engel with the title of "Spiraled Pony Tail Holder"; U.S. Pat. No. 5,878,755 issued to Crabtree and Mundell in 1999, entitled "Helical Hair Wrap Device"; U.S. D432,264 issued to Nicol in 2000 for a "Helical Hair Braid Holder"; U.S. D635,297 issued to Hsu in 2011 for a "Hair Clip"; U.S. 2007/0175493 listing Tandberg, Potter and Potter as inventors and published in 2007 with the title of "Hair Ornament Device"; and U.S. 2012/0211020 published in 2012 and listing Garcia as inventor with the title of "Helical Hair Tie."

The patents disclosing hair ties, clips, braids, rings or tubes include: U.S. Pat. No. 3,832,841 issued to Cole in 1974 for an "Ornamental Expansible Strip"; U.S. Pat. No. 5,404,892 issued in 1995 to Bretl for an "Apparatus and Method For Decorating Hair"; U.S. Pat. No. 5,881,736 issued in 1999 to Turner and Turner entitled "Apparatus and Method For Decorating Hair"; U.S. Pat. No. 6,041,792 issued to Kennedy for a "Hair Ornament and Method Ornamenting Hair"; U.S. Pat. No. 6,647,989 issued to DeBenedictis in 2003 titled "Hair Treatment Device and Method"; WIPO/PCT WO2012/174687 published in 2012 listing Xu as inventor and entitled "Elastic Rope"; French publication FR2 799 349 published in 2001 listing Nobuhiro as inventor and entitled "Personal Adornment"; and German DE298 01 558 U1 issued in 1998 for a "Hair Clip."

The patents disclosing devices for applying a helical or spiral cords to strands of hair or manipulating hair include: U.S. Pat. No. 5,671,759 issued to Chung, Snively and Beck in 1997 for a "Device For Wrapping Hair With Cord"; U.S. Pat. No. 6,260,559 issued in 2001 to Schirren and Flores for a "Method and Apparatus for Hair Styling"; U.S. Pat. No. 6,637,441 issued to Kennedy in 2003 for a "Hair Wrapper"; U.S. Pat. No. 6,662,808 issued in 2003 to Leason, Ellis and Lattuga for a "Hair Wrapper"; and U.S. Pat. No. 7,328,710 issued in 2008 to Hall and Crowley for a "Hair Retention Device and Method of Using Same."

These patents and devices are of some interest, however, they do not disclose or illustrate a hair decorating system as disclosed in detail below.

SUMMARY OF THE INVENTION

In accordance with the present invention, an advantageous method and system are provided in the form of a hair decorating system and a method for making a hair decorating system. The system is simple in structure, easy to manufacture, fun and easy to use, and inexpensive. The result of using the system is a very attractive and decorative hair design.

Briefly summarized, the invention relates to a hair decorating system including a length of string having a first end segment, an interior segment contiguous with the first end segment, an exterior segment contiguous with and coiled around the interior segment, and a second end segment contiguous with the coiled exterior segment, wherein the first and second end segments are attached and the coiled exterior segment is enabled to move from a compressed coiled position to an extended position. The system may also include a tool for pulling a strand of hair through the coiled exterior segment.

The invention also relates to a method of making the hair decorating system including the steps of providing a length of string having contiguous first and second end segments, an interior segment and an exterior segment, forming a layer of wax around the length of string, restraining the first end segment and the interior segment, coiling the exterior segment around the interior segment in a direction toward the first end segment, and attaching the first and the second end segments.

BRIEF DESCRIPTION OF THE DRAWINGS

For the purpose of facilitating an understanding of the invention, the accompanying drawings and detailed description illustrate preferred embodiments thereof, from which the invention, its structures, its construction and operation, its processes, and many related advantages may be readily understood and appreciated.

DESCRIPTION OF THE PREFERRED EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
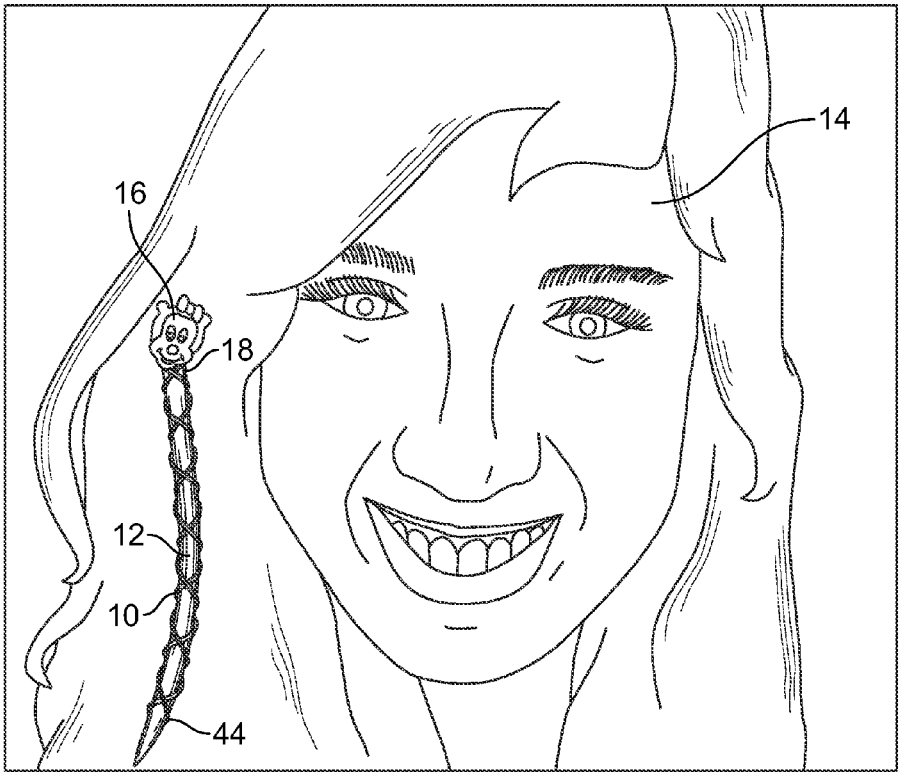
FIG. 1 is an isometric view of a crisscross string pattern around a strand of hair of a user.

Referring now to FIG. 1, there is shown an extended, crisscrossed length of string 10, part of the inventive hair decorating system disclosed and claimed herein, around a strand of hair 12 from the head of a girl 14. As an option, a clip 16, such as one having a MINNIE MOUSE® face, may be attached to the hair strand at an upper end portion 18 of the crisscross length of string 10.

Figure 2:
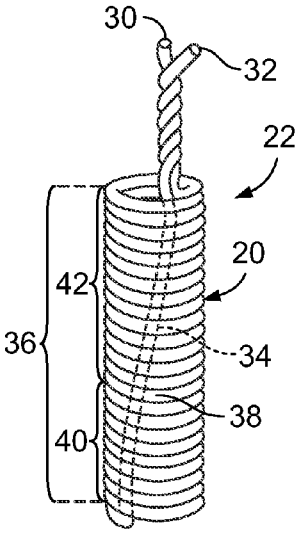
FIG. 2 is an isometric view of a string in a compressed coil.
Figure 3:
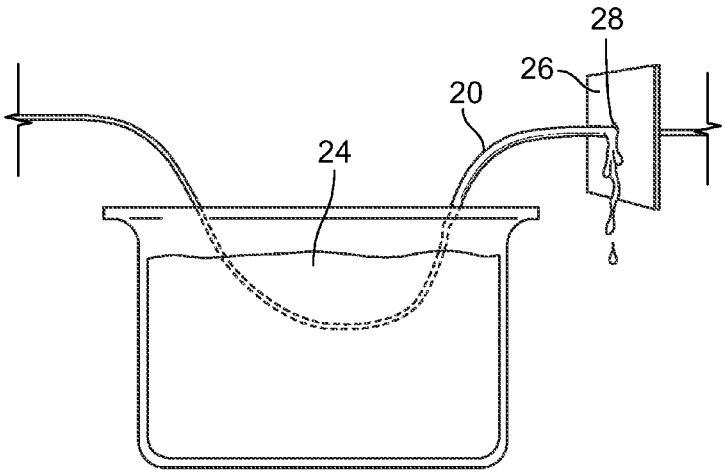
FIG. 3 is an isometric view of a coating being applied to the string before the string is coiled.

The crisscrossed string 10 may be formed from a length of wax-coated string 20, FIG. 2, where the string itself may be formed from three strands of thread twisted together. The string/thread may be made from polyester material. The string 20, in a first configuration, may be relaxed as shown in FIG. 3. After being coated with wax, the string is wound into a second configuration, that of a compressed cylindrical coiled 22, as shown in FIG. 2. The string 20 of the coil 22, when in the pre-coiled or relaxed, first configuration, is generally loose and linear and has a preferred length of about 540 mm. The preferred diameter of the string is about 0.7 mm. In the second, coiled configuration 22, the length of the coil is about 24 mm with an inner diameter of about 6.5 mm. In a third configuration shown in FIG. 1, the string 20 forms an attractive, decorative crisscrossed pattern extended along a strand of hair and may have a length of about 160 mm.

In the alternative, the material of the string may be rayon, cotton, silk, or wool, or a combination of such material, and metallic fibers may be added for additional decoration. Twisting three strands of thread allows the option of mixing colors and materials; however, non-twisted thread may be used and more or less than three strands may be configured, if desired. The length of the crisscrossed coil may vary, and different lengths may be marketed, one of which, for example, may extend in the crisscrossed pattern to about 200 mm. If less hair is bundled and engaged by the coil, the coil may be extended to a longer length. The diameter of the string may also be thicker than the 0.7 mm mentioned above and may, for example, measure about 1 mm.

Before coiling, the string may be dipped in a hot microcrystalline wax 24, FIG. 3. The wax may be heated to about 100° C., such that when cooled, the wax adds rigidity and stickiness to the string 20. The wax may be smoothed out and excess wax removed by pulling the coated string through a template 26 having an opening 28 with about a 0.8 mm diameter. Pulling the string through the opening 28 insures that an appropriate amount of sticky wax covers the string 20 to a layer of about 0.05 mm thick. In the alternative, the wax may be a mixture of half microcrystalline wax and half paraffin. Still another alternative may be the use of silicon adhesive in place of wax. Also in the alternative, the wax or adhesive covering may amount to a layer of different dimension, for example, about 0.08 mm thick.

It is noted that several strands of hair may be decorated with crisscrossed coils of string instead of the one such coil shown in FIG. 1, and that the wax or adhesive may be applied differently, such as by a spray, after the compressed coil is formed. It is also noted that the term "strand of hair," means a group of hair shafts bundled together to have an approximate diameter of about 4 mm. It appears that earlier patents may have referred to such bundled hair shafts as a "lock of hair," a "bunch of hair," a "tress of hair," and a "braid of hair."

The string 20 in the compressed coiled configuration 22, FIG. 2, may have a first end segment 30, a second end segment 32, a first string or interior segment 34 contiguous with and extending away from the first end segment 30, and a second coiled or exterior segment 36 contiguous with and extending away from the interior segment 34 and contiguous with and extending to the second end segment 32. The string 20 also includes a center region 38 that in the preferred embodiment is generally equidistant from each of the first and second end segments 30, 32. For clarity, the exterior segment 36 may be divided into a first or lower coiled portion 40 contiguous with and extending from the interior segment 34 to about the center region 38 and a second or upper coiled portion 42 contiguous with the first coiled portion 40 and extending between the center region 38 and the second end segment 32.

Figure 4:
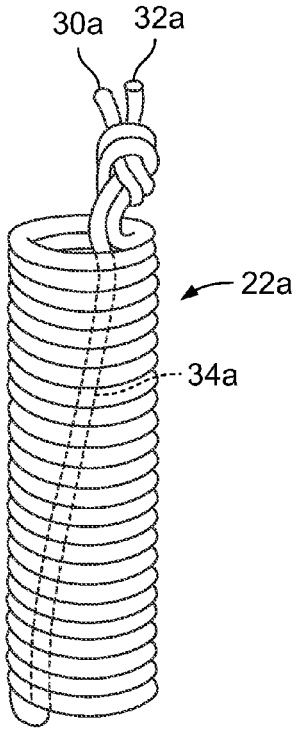
FIG. 4 is an isometric view of another embodiment of a compressed string coil.
Figure 5:
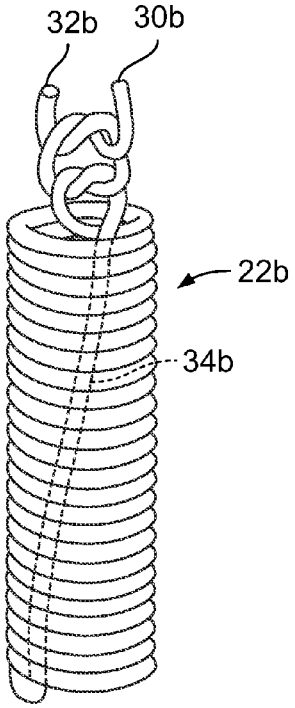
FIG. 5 is an isometric view of still another embodiment of a compressed string coil.
Figure 6:
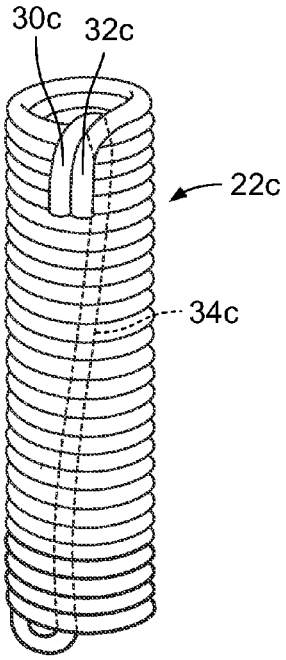
FIG. 6 is an isometric view of yet another embodiment of a compressed string coil.

In the coiled second configuration 22, FIG. 2, the first end segment 30 and the second end segment 32 extend from the upper end of the exterior segment 36 and are twisted to a length of about 22 mm. (It is noted that FIG. 2 is not drawn to scale.) In the alternative, compressed coils 22*a*, 22*b*, 22*c*, FIGS. 4-6, may have end portions 30*a*, 32*a* and 30*b*, 32*b* knotted as shown in FIGS. 4 and 5, respectively, or the end portions 30*c*, 32*c* may be attached by an adhesive or the stickiness of the wax as shown in FIG. 6. (It is noted that FIGS. 4-6 are not drawn to scale.) In a preferred embodiment, the interior segment 34, FIG. 2, may extend about 24 mm and is located inside the exterior segment 36, hence the labels "interior segment" and "exterior segment." The lower coiled portion 40 may extend about 9 mm and the upper coiled portion 42 may have a length of about 15 mm. When extended to the crisscrossed configuration shown in FIG. 1, the center region 38 of the string will be located generally at a lower end 44, FIG. 1, of the crisscrossed configuration 10 because when the compressed coil is extended, string is pulled away from each of the lower and the upper coiled portions 40, 42 of the exterior segment 36. The interior segment 34 adjacent the first end segment 30 pulls the lower coiled portion 40 while the upper coiled portion 42 extends downward so as to open the compressed coil and result in the crisscrossed pattern formed by the interior segment 34 and lower coiled portion 40 of the exterior segment on the one hand, and the upper coiled portion 42 of the exterior segment on the other hand.

Figure 7:
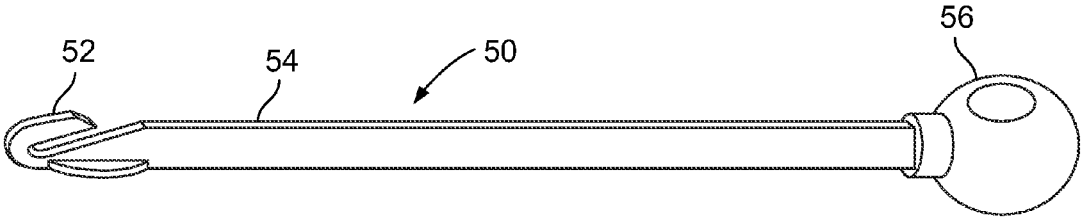
FIG. 7 is an isometric view of a tool for pulling a strand of hair through a coil of string.
Figure 8:
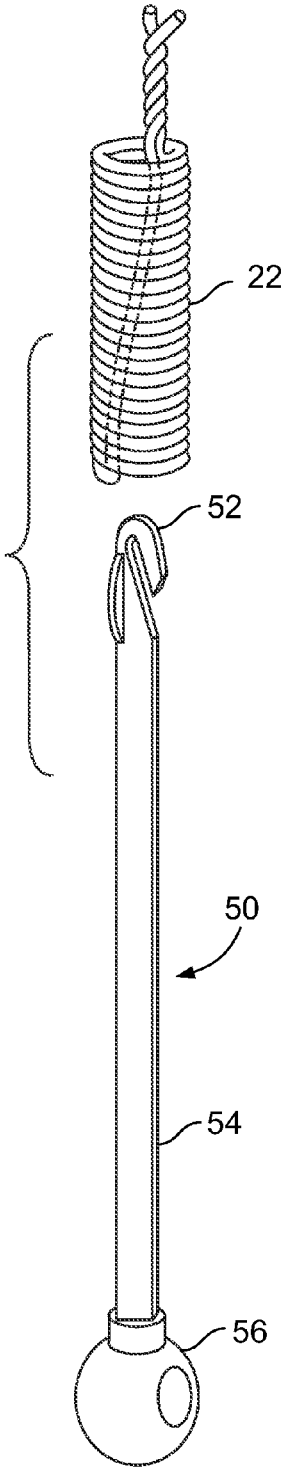
FIG. 8 is an isometric view of the pulling tool before receiving a compressed coil.
Figure 9:
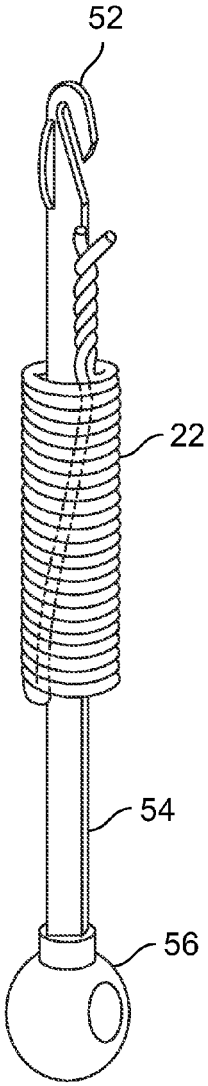
FIG. 9 is an isometric view of the tool with the received compressed coil.

Referring now to FIGS. 7-9, there is shown a second part of the preferred hair decorating system is the form of a tool 50 having a hook portion 52 at one end, an extended rod portion 54 in the middle of the tool 50, and a spherical handle 56 at an opposite end of the tool from the hook portion 52. In operation by a user, the compressed coil 22 is aligned by the user with the hook portion 52 of the tool, as shown in FIG. 8, and the user slides the compressed coil 22 over the hook portion 52 and onto the rod portion 54 resulting in the configuration of tool and coil shown in FIG. 9. The rod portion 54 is used to hold the compressed coil until a strand of hair engaged by the hook portion 52 is pulled through the compressed coil.

Figure 10:
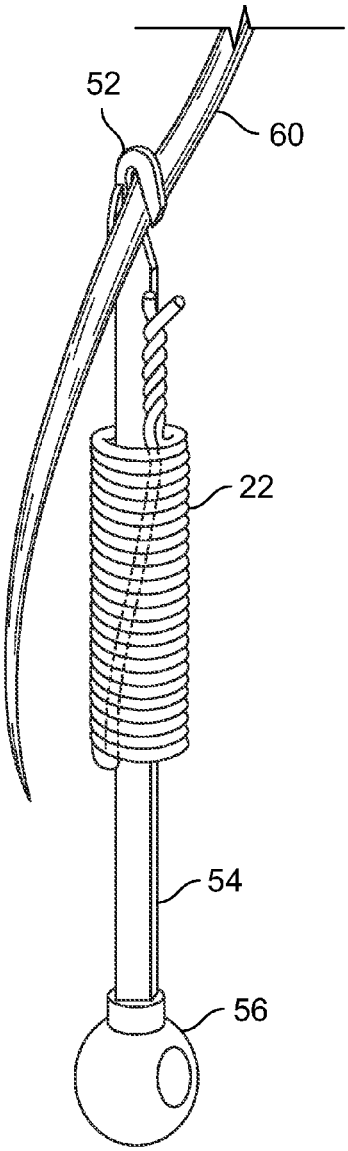
FIG. 10 is an isometric view of the tool, the received compressed coil and a strand of hair.
Figure 11:
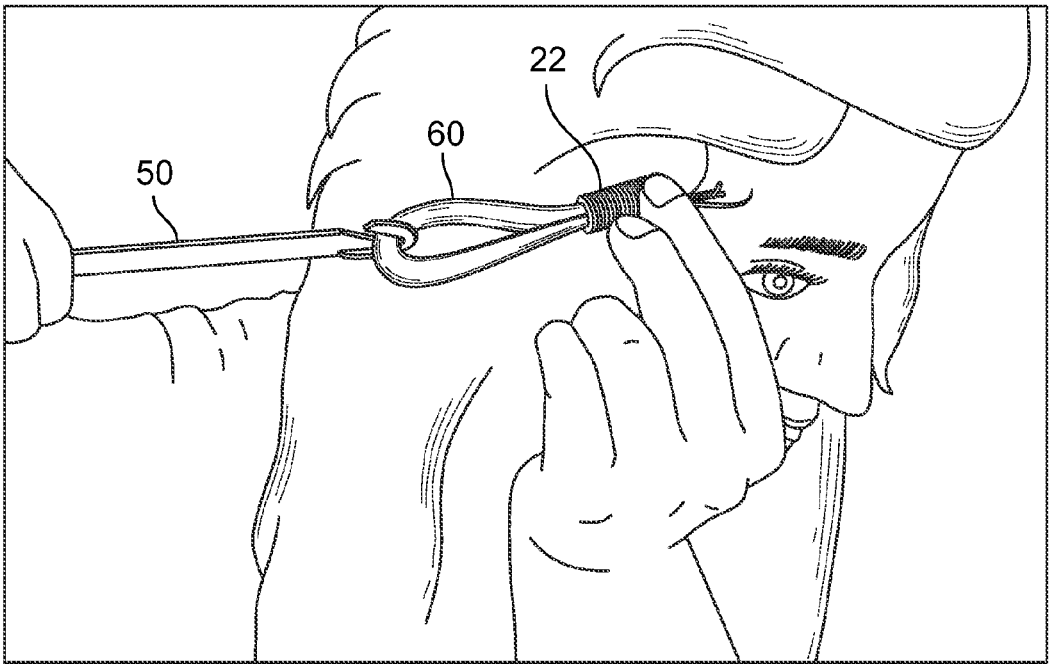
FIG. 11 is an isometric view of the strand of hair shown in FIG. 10, being pulled through the compressed coil.
Figure 12:
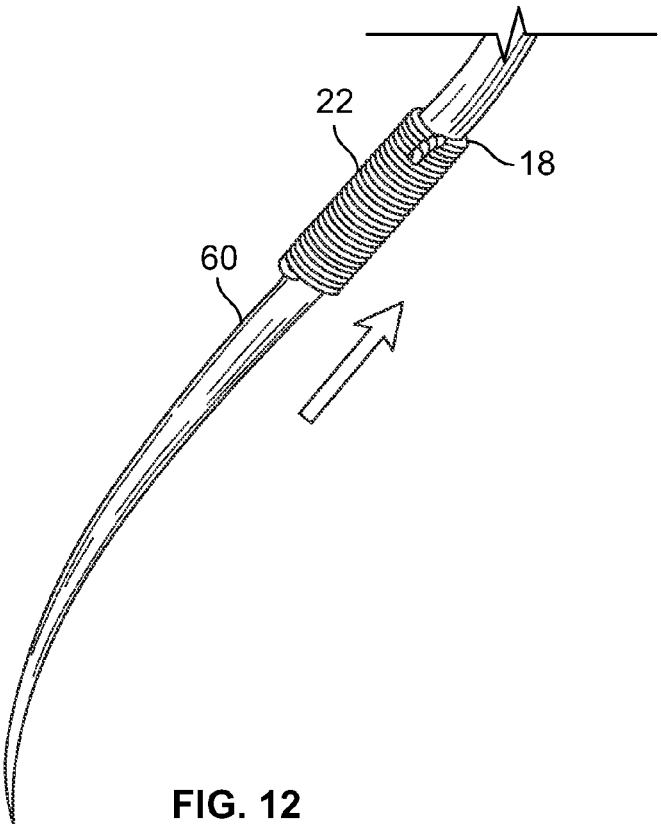
FIG. 12 is an isometric view of the compressed coil shown in FIGS. 10 and 11, being pushed upward on the strand of hair.
Figure 13:
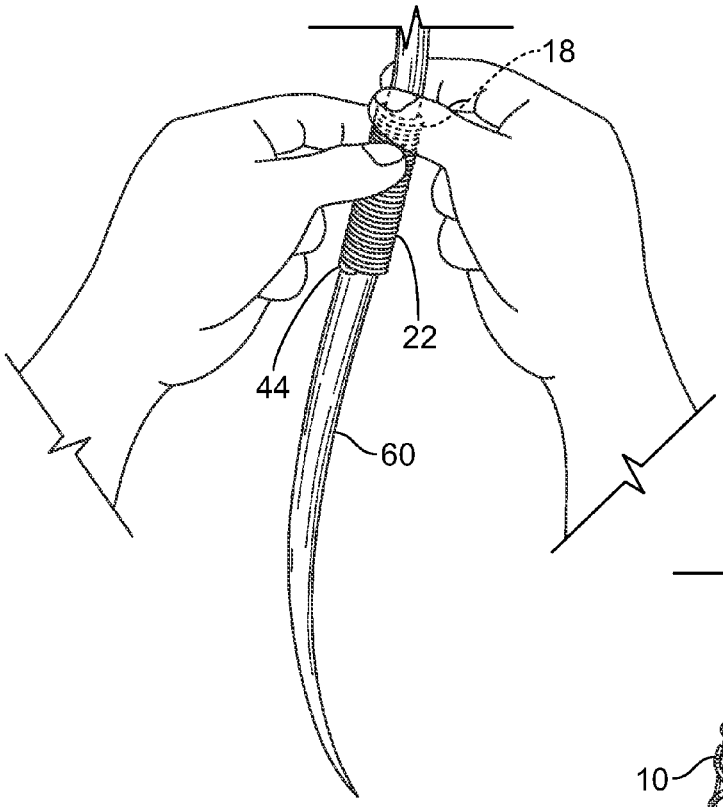
FIG. 13 is an isometric view of the strand of hair and the compressed coil shown in FIGS. 10-12, illustrating the hands of a user gripping the coil before its extension.
Figure 14:
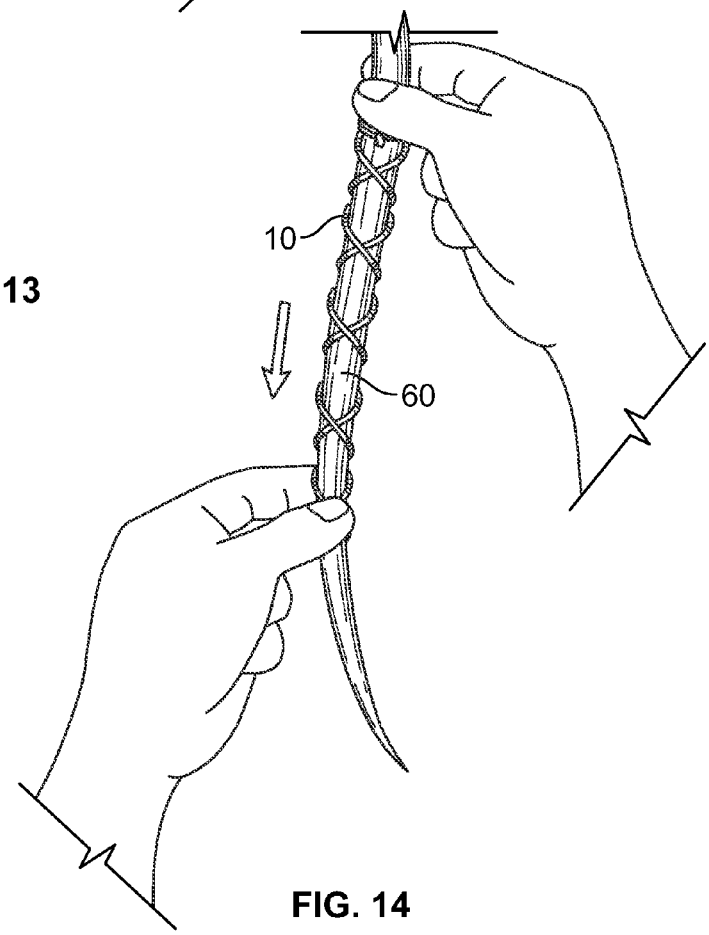
FIG. 14 is an isometric view of the strand of hair and the coil shown in FIGS. 10-13, illustrating the hands of a user during extension of the coil.

The hook portion 52 enables a user to engage a strand of hair 60, as shown in FIG. 10. The hook portion 52 is pulled in one direction while the compressed coil 22 is held and pushed in an opposite direction so that the stand of hair 60 becomes looped and is passed through the compressed coil 22 as shown in FIG. 11. After the strand of hair 60 is pulled through the compressed coil, the tool is disengaged from the strand of hair and the user may slide the compressed coil upward on the strand of hair 60 toward the epidermis of the head as shown in FIG. 12. A user may then squeeze the upper end 18 of the compressed coil 22 to cause a tight engagement of the wax and the shafts of the strand of hair 60. Once tightly in position, the user grips the upper end 18 of the compressed coil 22 with one hand as shown in FIG. 13, and grips the compressed coil 22 with the other hand as close to the upper end 18 as possible. The user then pulls the other hand downward as shown by the arrow in FIG. 14, to extend the coil to the final crisscrossed configuration 10 shown in FIG. 1.

It is important that the user grips the compressed coil 22 as near the upper end 18 as possible such that the compressed coil is able to be stretched or unwound from both the upper and the lower portions of the exterior segment. When done correctly, the lower end 44 of the coil in the final configuration is formed at about the center region 38 of the string 20. The tight fit of the coil to the strand of hair 60 prevents the coil from slipping downward and/or disengaging from the strand of hair after being extended.

Figure 15:
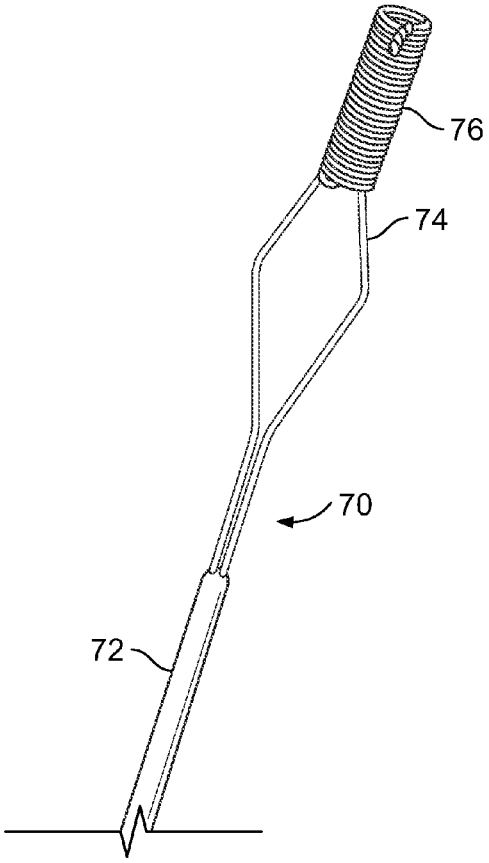
FIG. 15 is an isometric view of another hair pulling tool embodiment and a compressed coil.
Figure 16:
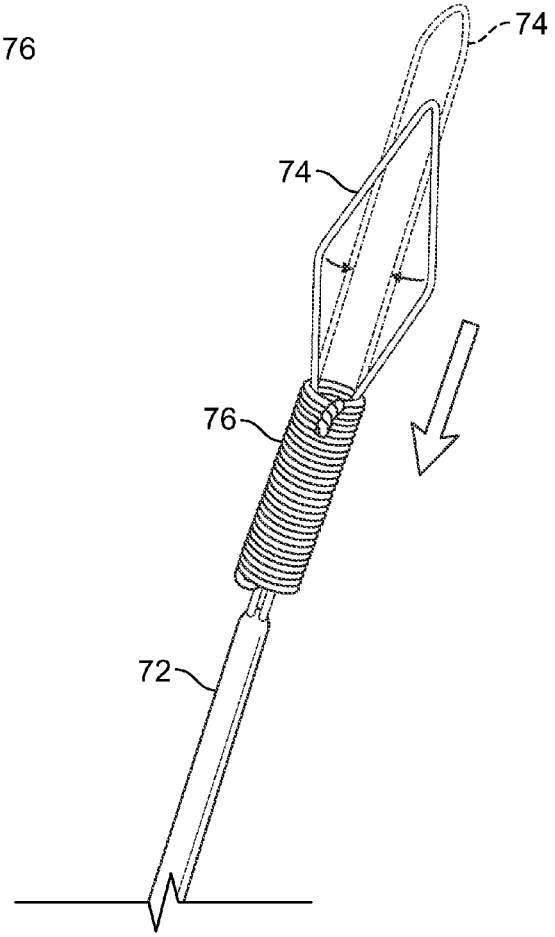
FIG. 16 is an isometric view of the tool embodiment shown in FIG. 15, with the compressed coil received by the tool.
Figure 17:
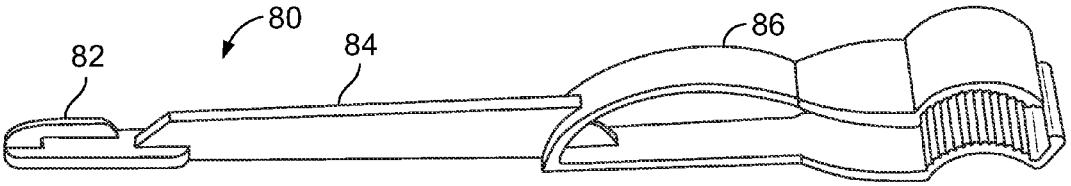
FIG. 17 is an isometric view of still another hair pulling tool embodiment.

In the alternative, other tools may be used with the system, such as a tool 70, FIG. 15, having a handle portion 72 and a flexible diamond shaped wire portion 74. The coil 22 is slipped over the wire portion 74 and the wire portion 74 flexes inward to allow the coil to pass to the handle portion 72 as indicated by the arrow in FIG. 16. Thereafter, a user threads a strand of hair through the expanded diamond shaped wire portion 74 as done with the hook portion 52 of the tool 50, and the user then pulls the strand of hair through the compressed coil. Another tool 80 is shown in FIG. 17. The tool 80 includes a hook portion 82, a rod portion 84, and a pincers portion 86. The hook and rod portions 82, 84 operated as already explained above with regard to the tools 50 and 70. The pincers portion 86 may be used to squeeze the coil to the strand of hair.

Figure 18:
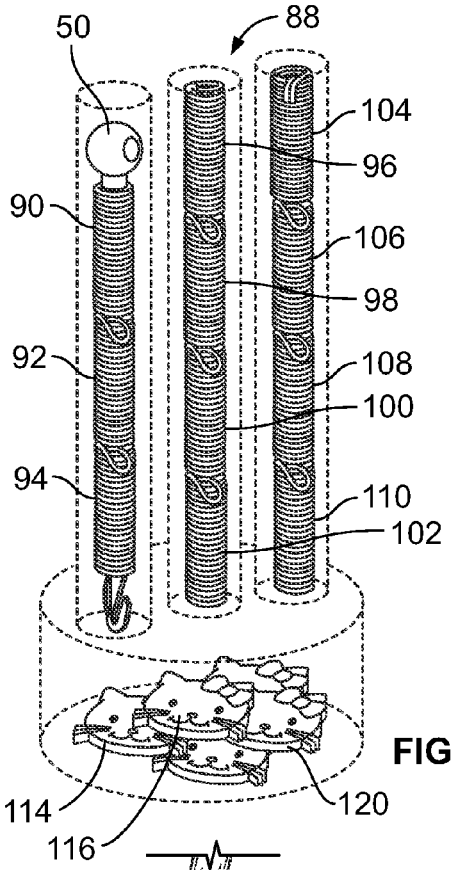
FIG. 18 is an isometric view of a hair decorating kit with the hair pulling tool shown in FIG. 7, multiple compressed coils in a jewelry type box along with clips packaged for sale to consumers.
Figure 19:
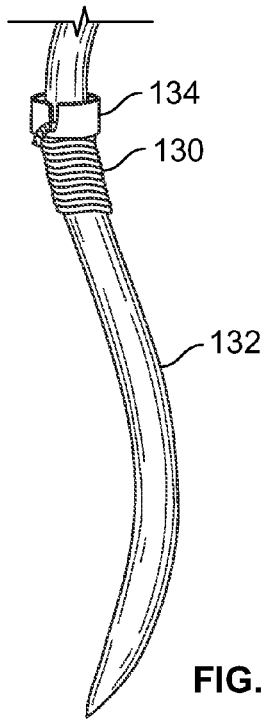
FIG. 19 is an isometric view of a strand of hair, a compressed coil around the strand and a hair clip.
Figure 20:
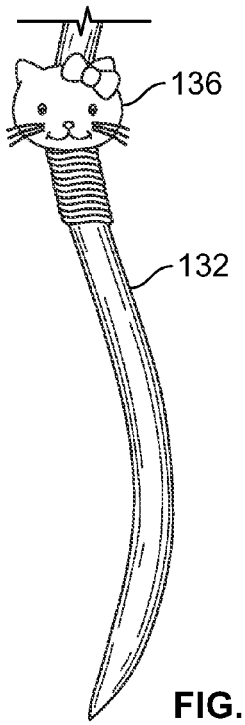
FIG. 20 is an isometric view of the strand of hair, the compressed coil around the strand shown in FIG. 19 with a hair clip cover having a HELLO KITTY® face.
Figure 21:
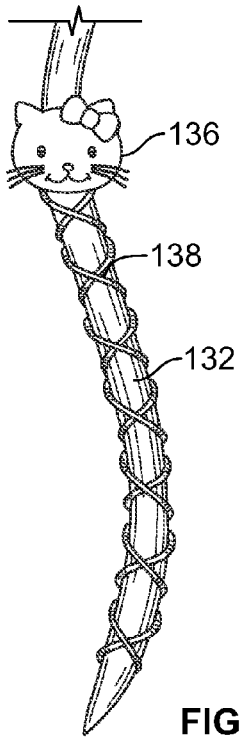
FIG. 21 is an isometric view of the strand of hair and the hair clip shown in FIG. 20, illustrating the coil in an extended crisscross configuration.

Referring now to FIG. 18, there is illustrated a hair decorating kit 88 including the tool 50, eleven compressed coils 90, 92, 94, 96, 98, 100, 102, 104, 106, 108, 110 attractively displayed and stored into a jewelry type box 112 that may contain decorative clips such as the clips 114, 116, 118. Referring now to FIGS. 19-21, there is shown a compressed coil 130 around a strand of hair 132 with a clip holder 134 positioned at the upper portion of the compressed coil 130. The holder 134 may compress the upper portion of the compressed coil and/or may hold the compressed coil in place. The holder 134 may also act as a support for a decorative clip 136, FIG. 20, shown in the form of a HELLO KITTY® face. The coil is shown in an extended crisscross configuration 138 in FIG. 21. In the alternative, other decorative clips may be used.

Figure 22:
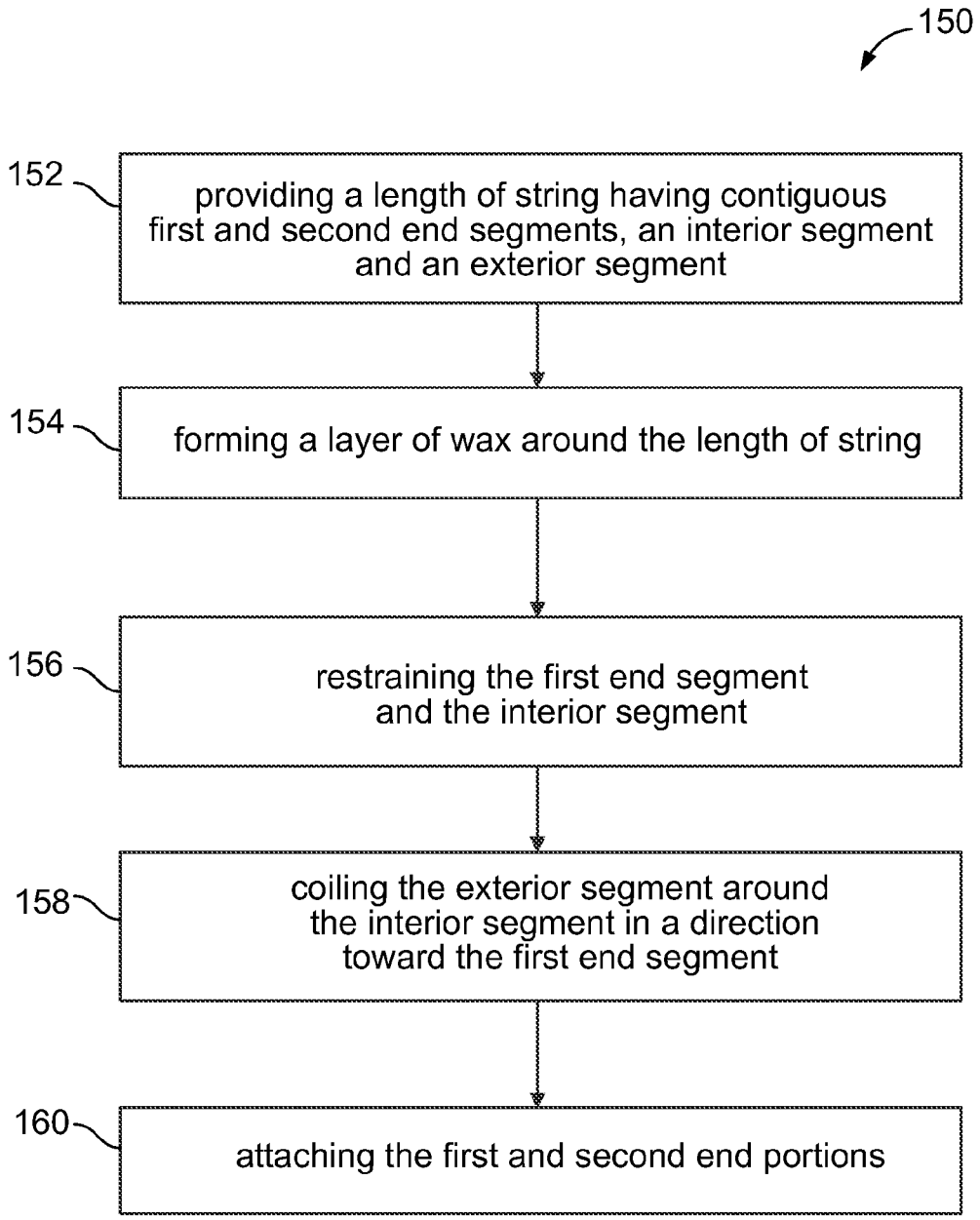
FIG. 22 is a flow diagram of a method for making a compressed coil of the present invention.

The present invention also includes a method of making a hair decorating system 150, FIG. 22, including the steps of providing a length of string having contiguous first and second end segments, an interior segment and an exterior segment 152, forming a layer of wax around the length of string 154, restraining the first end segment and the interior segment 156, coiling the exterior segment around the interior segment in a direction toward the first end segment 158, and attaching the first and the second end portions 160.

The hair decorative system disclosed in detail above is fun to use and easy to operate or apply and very attractive. The system is safe, even for young children, and yet the hair decorating system is a simple and robust structure that may be produced at a reasonable cost.

From the foregoing, it can be seen that there has been provided features for an improved hair decorating system and a disclosure of the method for making a part of the system. While particular embodiments of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A hair retaining and decorating system comprising:

a length of string having a first end and a second end, the first end at a first end segment, an interior segment contiguous with the first end segment, an exterior segment contiguous with and coiled around the interior segment, and a second end segment contiguous with the coiled exterior segment, the second end segment being contiguous with the second end wherein the first end and second end of the length of string are attached to close the length of string at the first end and the second end, wherein the coiled exterior segment has an upper coiled portion proximate the first and second ends and a lower coiled portion positioned between the upper coiled portion and the interior segment;

the string having a wax or silicone adhesive coating thereon to improve rigidity and stickiness, where the thickness of said wax or silicone adhesive coating is about 0.05 mm or about 0.08 mm, and the coiled exterior segment is enabled to move from a compressed coiled position to an extended position where the upper portion of the coiled exterior segment extends downward to open the compressed coil and the lower portion of the exterior segment is pulled by the interior segment creating a crisscrossed pattern between the upper portion of the exterior segment and the lower portion of the coiled exterior segment and interior segment in use a lock or bundle of hair is passed through the interior of the string in the coiled compressed configuration such that the hair extends completely there through and the string is move to the extended portion by gripping the first and second ends and pulling the upper portion of the coiled exterior segment in a downward direction away from the first and second ends.

2. The hair retaining and decorating system of claim 1, wherein: the lower coiled portion of the coiled exterior segment extends to a center region of the coiled exterior segment and the upper coiled portion contiguous with the first lower coiled portion extends from the center region to the second end segment.

3. The hair retaining and decorating system of claim 1, wherein: the coiled exterior segment uncoils from both the upper coiled portion and the lower coiled portion.

4. The hair retaining and decorating system of claim 1, including: a tool for inserting a strand of hair into the coiled exterior segment.

5. A hair retaining and decorating system comprising:

a length of string having a first end segment, an opposite second end segment, an interior segment contiguous with and extending from the first end segment, a first coiled exterior segment contiguous with the interior segment, and a second coiled exterior segment contiguous with the first coiled exterior segment, the second coiled exterior segment extending to the opposite second end segment; wherein the string is arranged in a compressed coiled configuration where the first and opposite second end segments are attached to close the length of string at the first and second end segments and the first and second exterior segments have a first diameter and a first length and are coiled around the interior segment;

the string has a wax or silicone adhesive coating thereon to improve rigidity and stickiness, where the thickness of the wax or silicone adhesive coating is about 0.05 mm or about 0.08 mm, and the length of string is enabled to move from the compressed coiled configuration to an extended crisscrossed configuration, where the crisscross configuration is achieved by pulling the second coiled exterior segment in a direction toward the first coiled exterior segment and away from the first and second end segments such that the second coiled exterior segments extends axially and the first coiled exterior segment is pulled by the interior segment so that the first coiled exterior segment cross with the second coiled exterior segment, the pattern having a second diameter smaller than the first diameter and a second length longer that the first length;

in use a lock or bundle of hair is passed through the interior of the string in the coiled compressed configuration such that the hair extends completely there through prior to moving the string from the compressed coiled configuration to the extended crisscrossed configuration.

6. The hair decorating system of claim 5, including: a tool for inserting a strand of hair into the coiled exterior segments.

7. A hair retaining and decorating apparatus comprising:

a length of string having a first end and a second end, the first end at a first end segment, an interior segment contiguous with the first end segment, an exterior segment contiguous with and coiled around the interior segment, and a second end segment contiguous with the coiled exterior segment, the second end segment being contiguous with the second end of the length of string at the second end segment wherein the first end and second end of the length of string are attached to close the length of string at the first end and the second end, wherein the coiled exterior segment has an upper coiled portion proximate the first and second ends and a lower coiled portion positioned between the upper coiled portion and the interior segment;

the string having a wax or silicone adhesive coating thereon to improve rigidity and stickiness, where the thickness of said wax or silicone adhesive coating is about 0.05 mm or about 0.08 mm, and the coiled exterior segment is enabled to move from a compressed coiled position to an extended position where the upper portion of the coiled exterior segment extends downward to open the compressed coil and the lower portion of the exterior segment is pulled by the interior segment creating a crisscrossed pattern between the upper portion of the exterior segment and the lower portion of the coiled exterior segment and interior segment the interior segment and portion of the exterior segment extend in a configuration having said portion cross with another extended portion of the exterior segment in use a lock or bundle of hair is passed through the interior of the string in the coiled compressed configuration such that the hair extends completely there through and the string is move to the extended portion by gripping the first and second ends and pulling the upper portion of the coiled exterior segment in a downward direction away from the first and second ends.

* * * * *